US006213625B1

(12) United States Patent
Leadford et al.

(10) Patent No.: US 6,213,625 B1
(45) Date of Patent: Apr. 10, 2001

(54) INVERTED APEX PRISMATIC LENS

(75) Inventors: Kevin F. Leadford, Conyers; Carl Timothy Gould, Decatur, both of GA (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 09/298,298

(22) Filed: Apr. 23, 1999

(51) Int. Cl.[7] ..... F21V 7/04

(52) U.S. Cl. ..... 362/331; 362/330; 362/338; 362/335

(58) Field of Search ..... 362/338, 330, 362/335

(56) References Cited

U.S. PATENT DOCUMENTS 3,829,680 * 8/1974 Jones ..... 362/330
5,043,856 * 8/1991 Levin ..... 362/336
5,057,984 * 10/1991 Kelley ..... 362/330
5,579,134 * 11/1996 Lengyei ..... 362/330
5,582,481 * 12/1996 Natsume ..... 362/336
5,833,355 * 11/1998 You et al. ..... 362/338
5,890,791 * 4/1999 Saito ..... 362/31
6,024,462 * 2/2000 Whitehead ..... 362/31

* cited by examiner

*Primary Examiner*—Sandra O'Shea
*Assistant Examiner*—Anabel M Ton
(74) *Attorney, Agent, or Firm*—Kenneth E. Darnell

(57) ABSTRACT

Light-transparent lens structures typically formed of conventional synthetic acrylic resins and intended for use as lenses in a lensed fluorescent troffer or similar lighting fixture, the lens structures of the invention are characterized by repeating patterns of conical or pyramidal depressions formed in the lens with upper portions or apices thereof being inverted. The lens structures of the invention preserve the angular relationships of lens material to air interfaces of conventional conical lens patterns, for example, and further preserve angular beam shaping capabilities while substantially reducing the amount of material needed to form the lens structures per se.

20 Claims, 6 Drawing Sheets

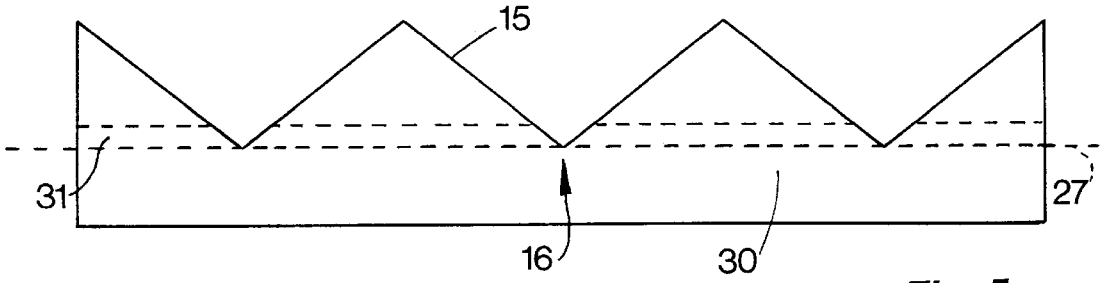
Fig. 5
Fig. 6
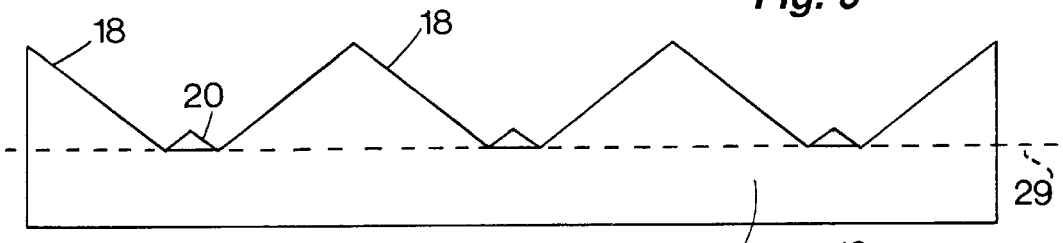
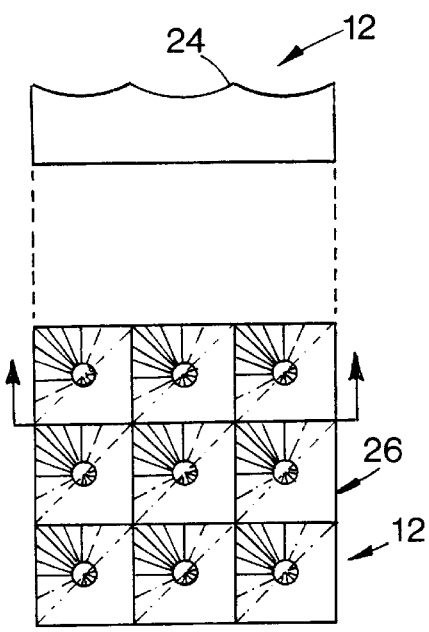
Fig. 7
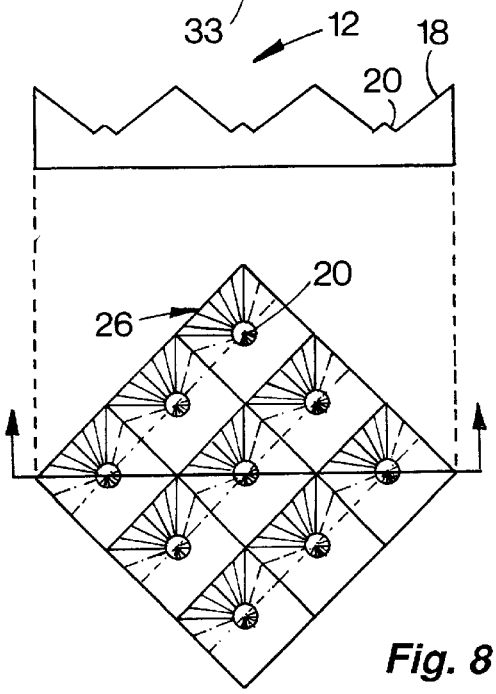
Fig. 8

INVERTED APEX PRISMATIC LENS

BACKGROUND OF THE INVENTION

1. Field of the Invention

The invention relates generally to patterned lens structures such as are used in conventional fluorescent lensed troffers, the invention relating particularly to lens structures having performance comparable to conventional lens structures while requiring substantially less material for forming of said lens structures.

2. Description of the Prior Art

Lenses used as covers for fluorescent lighting fixtures and fixtures utilizing other light sources are often referred to in the art as lighting panels, these panels or lenses being primarily used to reduce direct glare from fluorescent lighting fixtures and particularly such fixtures disposed overhead in commercial, office and other environments. In view of the manner in which light is distributed from a light source or sources within such lighting fixtures, these lighting panels or lenses are referred to as "prismatic" even though prisms are not necessarily used in formation of such lenses. Prismatic lenses used in lensed fluorescent troffers or similar lighting fixtures not only act to reduce direct glare by controlling the angle at which light emerges from the lens, these lenses also obscure lamping in the fixture by spreading light concentrations to produce a more aesthetically pleasing appearance.

The functions of prismatic lens structures are well known and are discussed inter alia in U.S. Pat. No. 2,474,317 to McPhail. The "lighting panels" described in this patent include a planar upper face and a lower face covered with "prismatic elements", light rays entering the top of the panel being either refracted downwardly through a lower surface of the panel at useful angles to the vertical, that is, normal to the panel, or are reflected internally by the prismatic elements upwardly through the upper surface of the panel. Formation of the prismatic elements to have straight sides making a proper angle with the normal to the panel causes virtually all light which would otherwise emerge at high angles relative to the normal to the panel to be internally reflected by the prisms or prismatic elements, thereby reducing or eliminating high angle "direct" glare.

While prismatic lenses of widely varying description have previously been devised including lenticular lighting panels such as are described by Harvath in U.S. Pat. No. 5,003,448, a particularly useful prismatic lighting panel is seen to have, on its lower surface, female conical prisms, the apices of which are aligned along 45° diagonals to the edges of the lens and spaced approximately 3/16 inch on center. Intersections of the cones thus form a structure of square cells, the sides of the cells lying along lattice lines running at angles of 45° to the edges of the lens. One example of such a lighting panel or lens is marketed by K-S-H, Inc. of St. Louis, Missouri under the trademarked designation KSH-12, this type of structure being generically known in the art as an A-12 lens.

The ubiquitous usage of lensed troffer lighting fixtures in a wide variety of commercial environments in particular has caused cost pressures to be exerted on the entirety of such fixtures and particularly on the prismatic lens structures forming covers of such fixtures and providing, as aforesaid, light control and reduction of lamp image. Since the plastic or "resinous" material from which these prismatic lenses are formed represents the primary cost of such lenses, these prismatic structures have been formed of increasingly thinner design until the point has been reached whereby even more thin structures are not permitted by geometry in order to further reduce weight. Additional weight reduction steps have involved reshaping of the female conical prisms by rounding straight edges of the conical prisms to make said prisms concave in cross-section. In such reformed prisms, prism apices have often been truncated or rounded off to permit formation of a prismatic lens using less material in its formation. However, while lenses of this type give the general appearance of an A-12 lens, such lenses are less effective optically and are generally known in the industry by another designation such as "pattern-12". Prismatic lenses of this nature provide higher and less sharply defined cut-off angles and therefore are relatively ineffective in controlling direct glare. As prismatic lenses have been made thinner and profiles modified, these lenses have also become less effective in hiding or spreading lamp images when viewed from below. Additionally, changes in prism geometry which have permitted formation of ultralight structures in thicknesses of less than 0.100 inch, typically 0.085 to 0.090 inch, have actually increased weight when formed as thicker lenses. In the manufacture of such lenses, multiple tooling is required such as through the use of a first embossing roll for thicknesses under about 0.090 to 0.100 inch and a second embossing roll for thicker panels in order to maintain a weight as low as possible for a given thickness. The weight of prismatic lenses, particularly of the pattern-12 type, have also been reduced by physically stretching the panel in a lengthwise direction, that is, in the direction of the axes of the fluorescent tubes in a rectangular lighting fixture, after embossing but before complete cooling of the plastic. Such stretching, however, creates stresses in the plastic and distorts the lattice pattern of intersecting prismatic cells.

Prismatic lenses, often referred to as prismatic lighting panels, are described in U.S. Pat. Nos. 2,474,217 to McPhail; 3,988,609 to Lewin; 5,003,448 to Harvath; 5,057,984 to Kelley; 4,542,449 to Whitehead and 5,274,536 to Sato, the disclosures of these patents being incorporated hereinto by reference. As is seen in part from the disclosures of the foregoing patents, a desirable objective in the formation of prismatic lenses is the reduction of material necessary for formation of said lenses due to a primary cost in the manufacture thereof being the amount of material necessary to form said lenses. The invention provides prismatic lighting panels or prismatic lenses capable of a highly desirable level of light control with a desirable reduction of lamp image relative to lens structures of the prior art, the present lens structures further being capable of manufacture from reduced quantities of acrylic or other suitable materials used in the formation of prismatic lens structures. Prismatic lens structures produced according to the invention therefore retain desirable operational characteristics and can be produced at relatively low costs.

SUMMARY OF THE INVENTION

In the several embodiments of the invention, lens structures find a particular use in lensed fluorescent troffers or similar lighting fixtures and are inexpensively formed of a substantially transparent thermoplastic material such as acrylic (polymethylmethacrylate), polystyrene or polycarbonate. The lens structures of the invention are configured to utilize reduced quantities of the materials forming the lens structures, thereby minimizing manufacturing cost. Through minimizing material usage, the lens structures of the invention also are low in weight while retaining strength sufficient to resist sagging or the like when in a use environment.

In a preferred embodiment of the invention, a lower face of a lens structure as used in a lensed fluorescent lighting fixture or the like has a pattern of female conical prisms formed thereover. Typically, such prisms have apex angles of about 112° to 120°, the prisms being arranged to intersect one another in a square pattern at an angle of 45°. Apices of the conical prisms are typically aligned along 45° diagonals to the edges of the structure and spaced on centers at distances of approximately 3/16 inch. According to the invention, apices of the conical prisms are inverted with a male conical prism identical to the apex of the female conical prism extending downwardly into said female conical prism. In other words, with reference to the lens itself, an inner conical portion of each female conical prism is inverted at the apex thereof and extends as a solid member into the depression in the lens structure formed by the female conical prism.

According to the invention, female pyramidal or other depressions can be formed in a lower face of a lens structure with an inner portion thereof being inverted, the lens structures of the invention whether formed by repeating patterns of conical, pyramidal or other depressions preserving the angular relationships of lens material to air interfaces of conventional conical lens patterns and further preserving angular beam shaping capabilities while substantially reducing the amount of material needed to form the lens structures.

Prismatic lighting panels or lens structures formed according to the invention are preferably formed of acrylic materials having weights which vary with thickness, the present lens structures having a strength essentially equal to that of conventional lens structures weighing substantially more per square foot than the lens structures of the invention, the present lens structures being less likely to sag under its own weight because of the lightweight nature of the lens structure per se.

Accordingly, it is an object of the invention to provide a prismatic lens structure having optical characteristics comparable with the characteristics of conventional prismatic lighting panels and the like having desirable lighting control and lamp image characteristics and which may be formed from lesser quantities of material than conventional prismatic lighting panels.

Another object of the invention is to provide a prismatic lens structure having desirable light control and substantial reduction of lamp image while being formed of lesser quantities of material than conventional prismatic lighting panel and which has sufficient structural rigidity to resist sagging in use as a cover for lamping in lensed fluorescent troffers and similar lighting fixtures.

It is a further object of the invention to provide prismatic lens structures capable of desirable reductions in lamp image capable of formation from reduced quantities of resinous materials such as acrylic materials while retaining the ability to resist sagging in typical use environments.

Further objects and advantages of the invention will become more readily apparent in light of the following detailed description of the preferred embodiments.

BRIEF DESCRIPTION OF THE DRAWINGS

FIG. 5 is an idealized elevational view of a lens structure illustrating the location of material removed according to the invention;

FIG. 6 is an idealized elevational view of the inverted apex lens structure of the invention of FIG. 4 illustrating the location and relative amount of material added to the structure by virtue of conforming the structure to the concepts of the invention;

FIG. 7 is an idealized illustration of the inverted apex prismatic lens structure of the invention showing related idealized plan and sectional views of the lens structure taken parallel to a grid formed of inverted apex prisms according to the invention;

FIG. 8 is an idealized illustration of the inverted apex prismatic lens structure of the invention showing related idealized plan and sectional views of the lens structure taken diagonally to a grid formed of inverted apex female conical prisms according to the invention;

DESCRIPTION OF THE PREFERRED EMBODIMENTS

Figure 1:
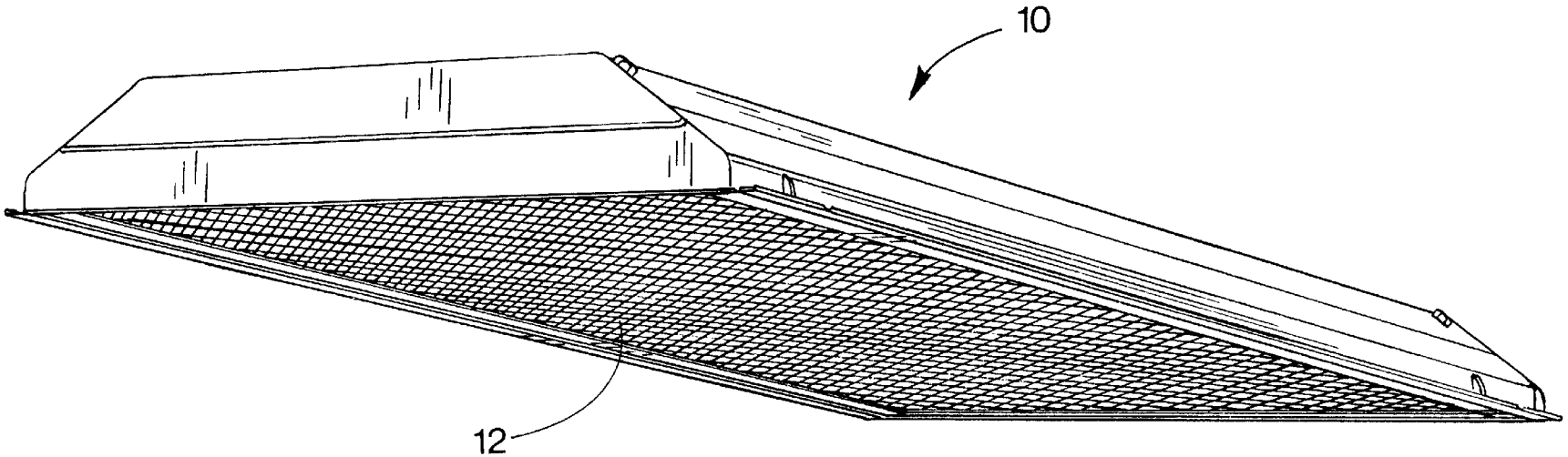
FIG. 1 is a perspective view of a lensed fluorescent troffer lighting fixture configured with a prismatic lens structure forming the cover of the fixture.
Figure 2:
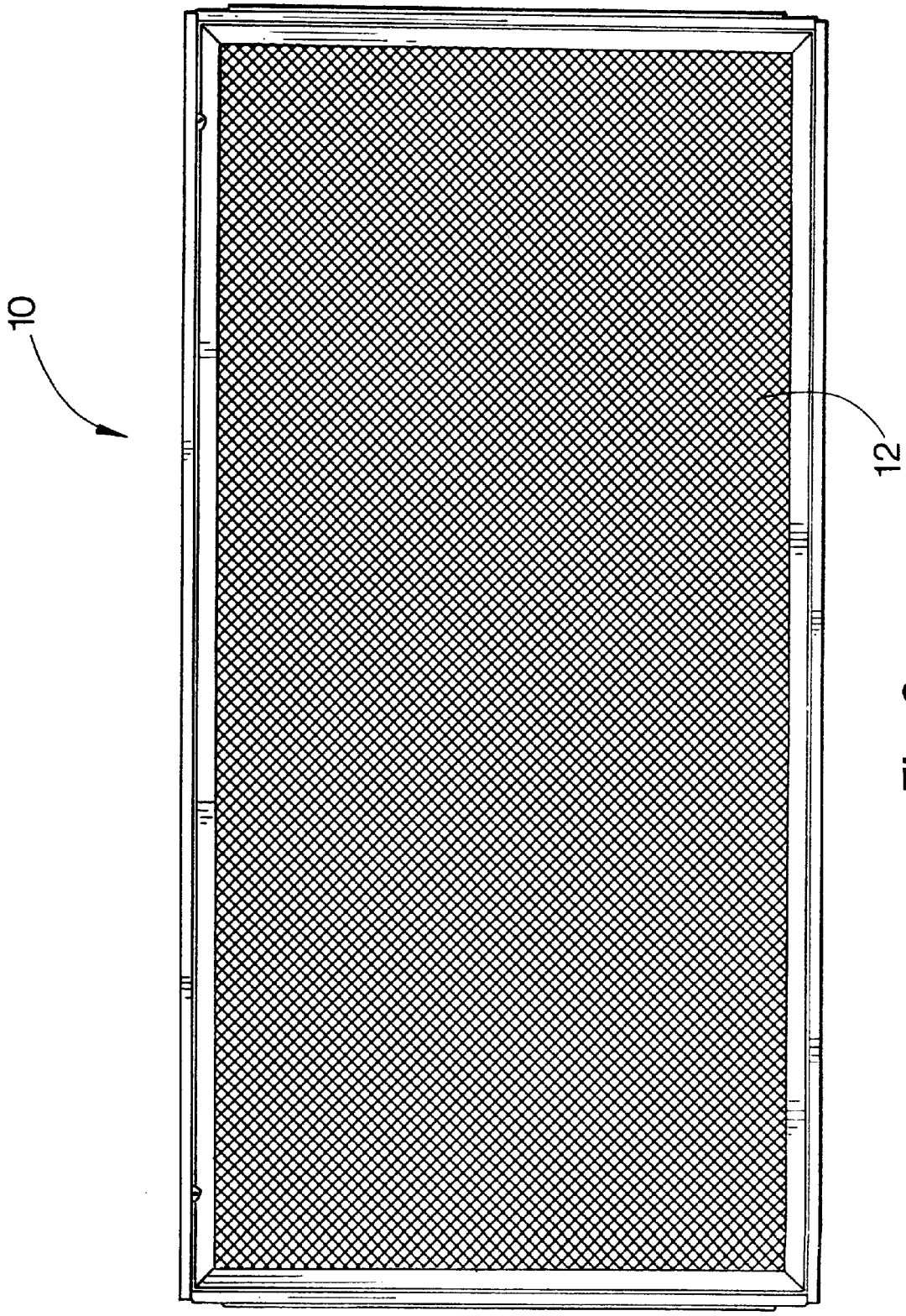
FIG. 2 is a bottom view of the fixture of FIG. 1 illustrating that portion of the fixture available for viewing in a use environment, that available portion being the cover formed by prismatic lens structures of the invention.
Figure 3:
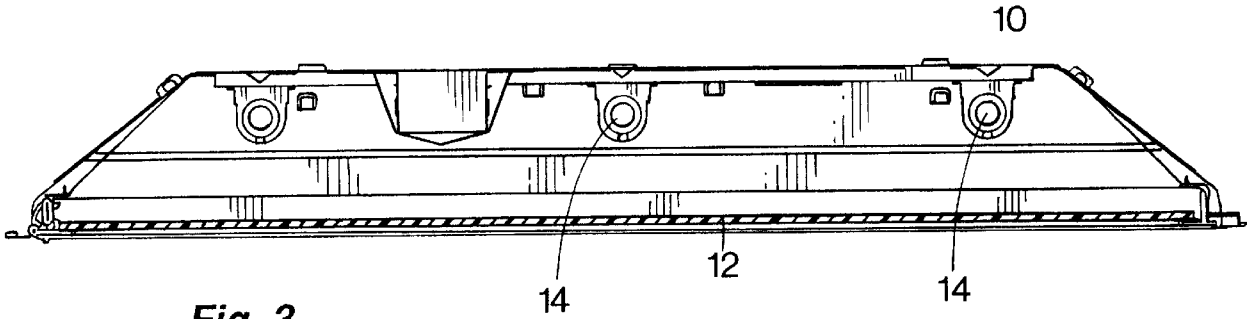
FIG. 3 is an elevational view of the lighting fixture of FIG. 1 with one of the end plate, removed to show the relationship between lamping and the prismatic lens cover of the invention in an assembled relationship in the fixture.
Figure 4:
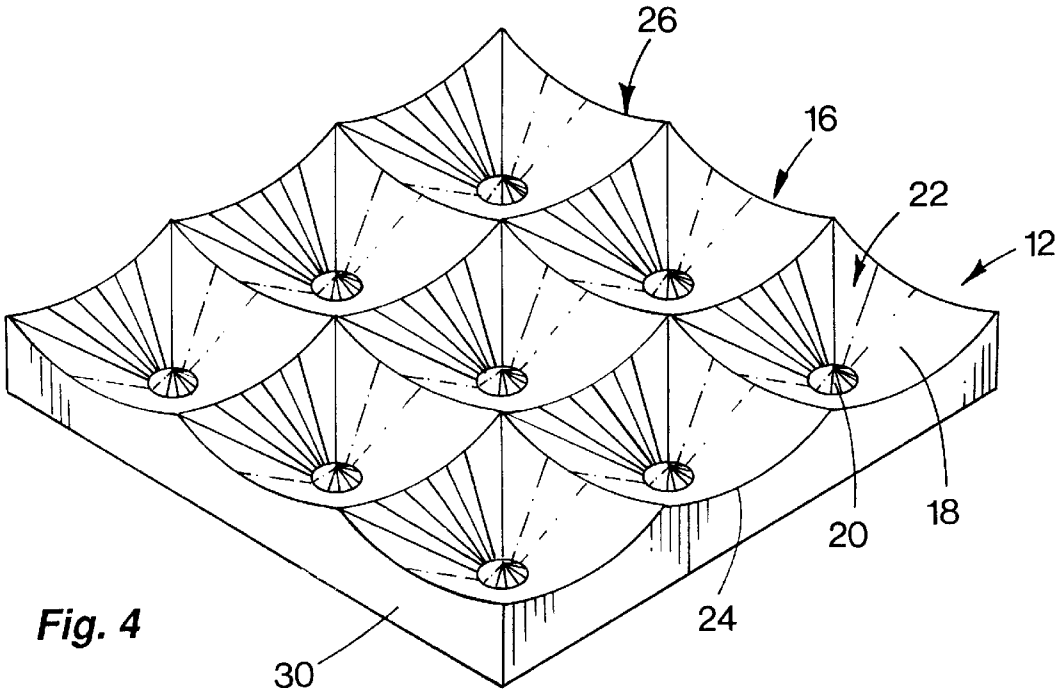
FIG. 4 is an idealized perspective view of one embodiment of a prismatic lens structure of the invention illustrating inversion of the apices of female conical prisms to form male conical prisms in inner portions of the female conical prisms.

Referring now to the drawings and particularly to FIGS. 1 through 3, a lensed fluorescent troffer lighting fixture is seen generally at 10, a fixture such as the fixture 10 being the kind of fixture which often utilizes a prismatic lens structure or prismatic lighting panel and which is referred to herein as lens 12. Fixtures such as the fixture 10 are typically 2 feet by 4 feet troffers and contain two to three lamps such as lamps 14 seen in FIG. 3, such fixtures being capable of arrangement in continuous rows spaced on appropriate centers to produce an average maintained illumination suitable for use in commercial environments including office environments. As will be understood by those skilled in the art, other arrangements of the fixtures 10 can be used including broken rows, checkerboard patterns, and modular spacings inter alia. Such direct, that is, downwardly emitting, lighting fixtures can be seen at regular viewing angles especially in applications having low ceiling height. Lighting fixtures such as the fixture 10 necessarily incorporate high angle light output control in order to avoid potential glare. Lensed troffer fixtures in particular use refractive lenses as an energy efficient means of controlling and shaping light output. Conventional prismatic lens structures or patterned lens sheet have long been used with fluorescent lighting fixtures such as the fixture 10 in commercial and office lighting applications, such geometrically patterned transparent lens sheet can be provided as the lens 12 to improve the quality and aesthetics of lighting derived from the fixture 10 by reduction of high angle light output and minimization of lamp image.

As mentioned supra, McPhail, in U.S. Pat. No. 2,474,317, describes a basic optical concept utilizing a conical prism lens pattern for use with fluorescent lighting fixtures and particular linear groupings of fixtures. The intent behind the use of clear, geometrically patterned lens sheet configured according to McPhail is the mitigation of potential glare by reduction of high angle light output as well as the obscuration of bright images provided by lamping such as the lamps 14 so that glare is reduced and aesthetics are improved. A lens geometry particularly favored by McPhail is formed of straight-sided male conical prisms arranged in a square grid, this pattern having become commonly known in the lighting industry as pattern A-19. This pattern consists of a plastic sheet, typically acrylic, which is planar on the back side, that is, the side facing lamping such as the lamps 14 of FIG. 3 with a prismatic pattern being formed on the exterior face of the sheet such as the exterior face of the lens 12. While not a separate sheet of material, the sheet thus formed is seen to incorporate a "base" sheet of unpatterned plastic on the planar side which assists in holding the article together and for providing rigidity.

Due to material cost considerations, a lens pattern known as A-12 has come into common use, the A-12 pattern being essentially the inverse of the A-19 pattern. The A-12 pattern is essentially comprised of female (inverse) prisms arranged in a square grid as is commonly provided in the prior art including certain of the references incorporated hereinto by reference. As is conventional in the art, the prisms intersect to form square cells in the grid with such cells typically being 3/16 inch on a side in order to provide desirable operational characteristics. The grid in such a pattern runs diagonally with respect to the edges of the entire lens sheet or lens such as the lens 12. The base diameter of the female cones in such an arrangement is equal to the diagonal length across a single square cell, this sizing necessitating that the cones be truncated vertically at the sides of the square cells where one inverse cone overlaps an adjacent cone. Scallop-shaped edges are thus formed in the material forming the lens, the ridges running parallel to the square grid. An A-12 pattern requires a larger volume of resinous material for formation than does an equivalent A-19 pattern, that is, an A-19 pattern having the same conical dimensions, the scallop-shaped ridges providing improved rigidity in the A-12 pattern. This increase in rigidity allows for a decrease in the thickness of the unpatterned "base" sheet and therefore a reduction in net material volume required per unit area of lens structure. The conventional A-12 pattern is therefore more cost effective due to the use of less material in its formation while providing comparable optical and structural properties. Methods of manufacture of prismatic lighting panel, particularly continuous extrusion methods, requiring embossing of only one side of the panel with an embossed roll, reduces the cost of production of prismatic lighting panel to the point where cost is determined almost entirely by the cost and quantity of the thermoplastic material used to form the lighting panel.

The original A-12 pattern has thus evolved toward further decrease of material volume, such evolution occurring primarily by distortion of the profile of the straight-sided conical prisms, lower production costs being accompanied by reduced optical performance in terms of high angle output and lamp image obscuration.

The lens 12 of the invention is seen in FIGS. 4 through 8 to be preferably formed of a prismatic pattern 16 conformed as female conical prisms 8 each having an inverted apex 20. Each inverted apex prism 18 forms a square cell 22 which intersects adjacent cells to form scallop-shaped ridges 24. The cells 22 in combination form grid 26, each cell 22 in the grid 26 preferably being approximately 3/16 inch on a side with the grid 26 running diagonally with respect to edges of a finished lens such as the lens 12. In the prismatic pattern 16 of the invention, the angular relationships of the material forming the lens 12 to air interfaces are essentially the same as high performance conventional prismatic lighting sheet. In essence, the same angles are preserved in the prismatic pattern 16 which any given light ray would have seen in high performance patterns such as the A-12 pattern. Light rays see the same angle structure and the light control and lamp image reduction inherent in conventional high performance prismatic lighting sheet is retained by the present prismatic pattern 16. However, the present prismatic pattern 16 allows for the use of lesser quantities of material than is necessary for production of the A-12 pattern, for example. A lens 12 formed of the prismatic pattern 16 continues to use the combination of a flat back surface and particular angles of conical prisms which determine principle and natural cutoff angles of effective prismatic lighting panels. When considering obscuring of lamp image, both cone profile and the size of the square grid in which the cones are arranged determine the performance of a given pattern. With a grid spacing which is too small, lamp images seen in each prism cell have too fine a spatial resolution for the eye to clearly detect and net lamp image will not effectively be broken up or obscured. A grid spacing which is too large will produce a lens with excessive thickness and material cost. A 3/16 inch grid spacing is a tested compromise between these extremes and is therefore the grid spacing preferred in the prismatic pattern 16.

The inversion of the apex 20 of each of the female conical prisms 18 cause the conical prisms 18 to extend a shorter distance into the body of the lens 12 than would occur if the prisms 18 were fully conical as in the conventional A-12 pattern. Material necessary to forming of the lens 12 is thus reduced as illustrated in FIGS. 5 and 6. While it can be contended that the reduction in material necessary to form the lens 12 is essentially proportional to the depth to which the apex 20 of each of the prisms 18 is inverted, it is to be understood that the extreme case of inverting half of the depth of the conical prisms 18 would essentially result in a combination of an A-12 and an A-19 pattern, that is, a pattern formed of female conical prisms each surrounding a male conical prism. Such a structure would perform adequately in the reduction of high angle light output due to preservation of the angular relationships of the patterned and unpatterned sides of the lens 12. However, grid cell size would be effectively reduced with an accompanying deterioration of the ability of such a structure to obscure lamp image effectively. The relatively small conical volume of the inverted apex 20 relative to the volume of the female conical prism 18 results in only a minimal reduction in the ability to obscure lamp image. Essentially, this smaller inversion only slightly changes the effective size and spacing of the lamp images seen in each grid cell. Further, the conical inverted apex 20 in the center of each cell is not visible from high angles since they are recessed within the scallop-shaped ridges 24 of the pattern 16 as noted above. The conical inverted apex 20 of each cell 22 thus does not contribute to a loss of lamp obscuration at critical viewing angles since the conical inverted apex 20 is hidden within the pattern 16 at high angle as is seen in a consideration of FIGS. 7 and 8.

Referring again to FIGS. 5 and 6 in particular, the pattern 16 of the prisms 18 does not extend into base sheet 30 seen in FIG. 5 as great a distance as the conical prisms 18 would alone if not inverted to form the respective apices 20 seen in FIG. 6, this consideration allowing the lens 12 of FIG. 6 to be formed with a base sheet 33 which is of the same thickness as the lens of FIG. 5. Note in FIG. 6 the addition of material to the lens occasioned by the additions of the apices 20, which apices 20 lie above dotted line 29 while the base sheet 33 lies below the line 29. A consideration of FIG. 5 shows that layer 31 which lies above dotted line 27 constitutes the quantity of material which would be removed from the non-inverted lens of FIG. 5 by practice of the invention as is illustrated in FIG. 6. As can readily be seen, substantially greater quantities of material are removed from the lens structure of FIG. 5 than are added to the lens structure of FIG. 6. The heights of the respective bases 30 and 33 of the lens structures of FIGS. 5 and 6 are essentially identical. The height of the layer 31 in FIG. 5 is essentially identical to the height of the apices 20 of FIG. 6. Further, the heights of the portions of the lens structure extending above the layer 31 in FIG. 5 are essentially identical to the heights of the portions of the lens structure extending above the dotted line 29 in FIG. 6. As indicated above, the unpatterned thicknesses of the bases 30 and 33 of FIGS. 5 and 6 remain the same. While the lens 12 is preferably formed of a transparent acrylic polymer as aforesaid, other standard transparent materials used in lens formation, such as light-stabilized polystyrene or glass, can also be used. A preferred thickness of such a lens 12 would typically lie in a range between approximately 0.125 inch and 0.080 inch.

Figure 9:
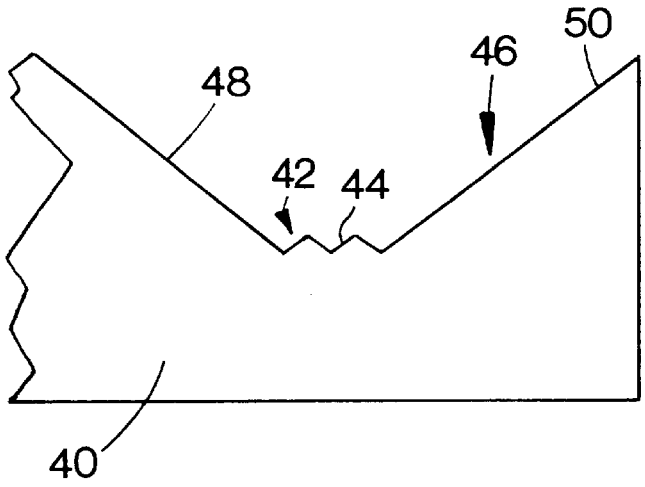
FIG. 9 is an elevational view in section of a secondary inversion lens pattern.

Referring now to FIG. 9, lens 40 is seen to be configured according to the invention as a unit which could be revolved or extruded in manufacture, the unit having a linear profile which would essentially have the cross-sectional shape of the lens 12 as seen in FIG. 8. Whether revolved or extruded, the inverted apex at 42 is again inverted, or formed as a secondary inversion 44 to produce an "M-shaped" profile extending along the lens 40 within an elongated trough 46 formed by walls 48 and 50. While the lens 12 as described hereinabove would usually be formed by forming techniques which are referred to as "revolving" the cell structure, the structure of FIG. 9 lends itself to forming either by revolving or by extrusion..

Figure 10A:
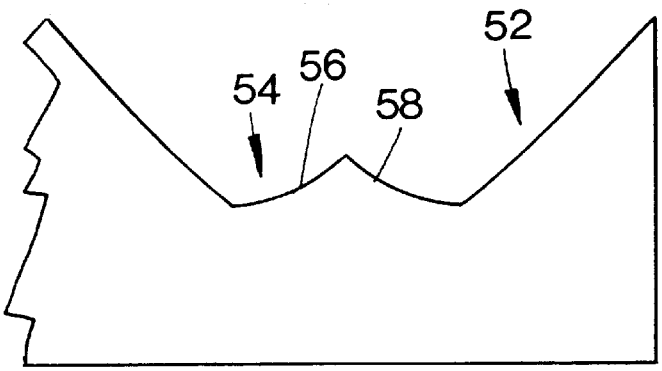
FIG. 10*a* is an idealized elevational view of a curved profile.
Figure 10B:
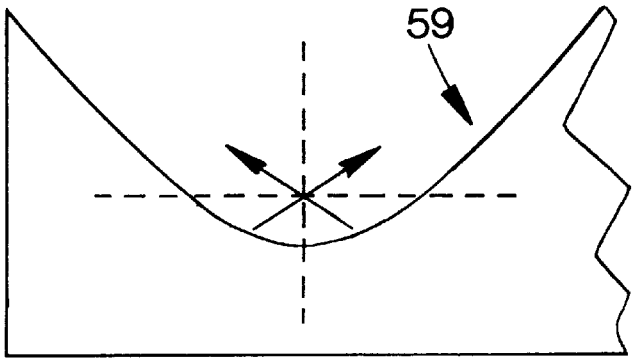
FIG. 10*b* is an elevational view of an inversion of the curved profile of FIG. 10*a*; and, FIG. 11 is a perspective view of an inversion of a linear profile forming a lens pattern as an extruded profile.

FIG. 10*a* illustrates a curved profile such as could be formed by revolving or extrusion, this structure not effectively forming a part of the invention. FIG. 10*a* is simply provided to show a curved profile which is inverted according to the invention to form the structure of FIG. 10*b*. When curved profile 59 of FIG. 10*a* is inverted to provide the inverted profile 52 of FIG. 10*b*, it is to be seen that ridge 54 is formed of sloping walls 56 and 58. Although not shown, the ridge 54 of FIG. 10*b* could be inverted a second time to form a secondary inversion of the general type as is seen in FIG. 9.

Figure 11:
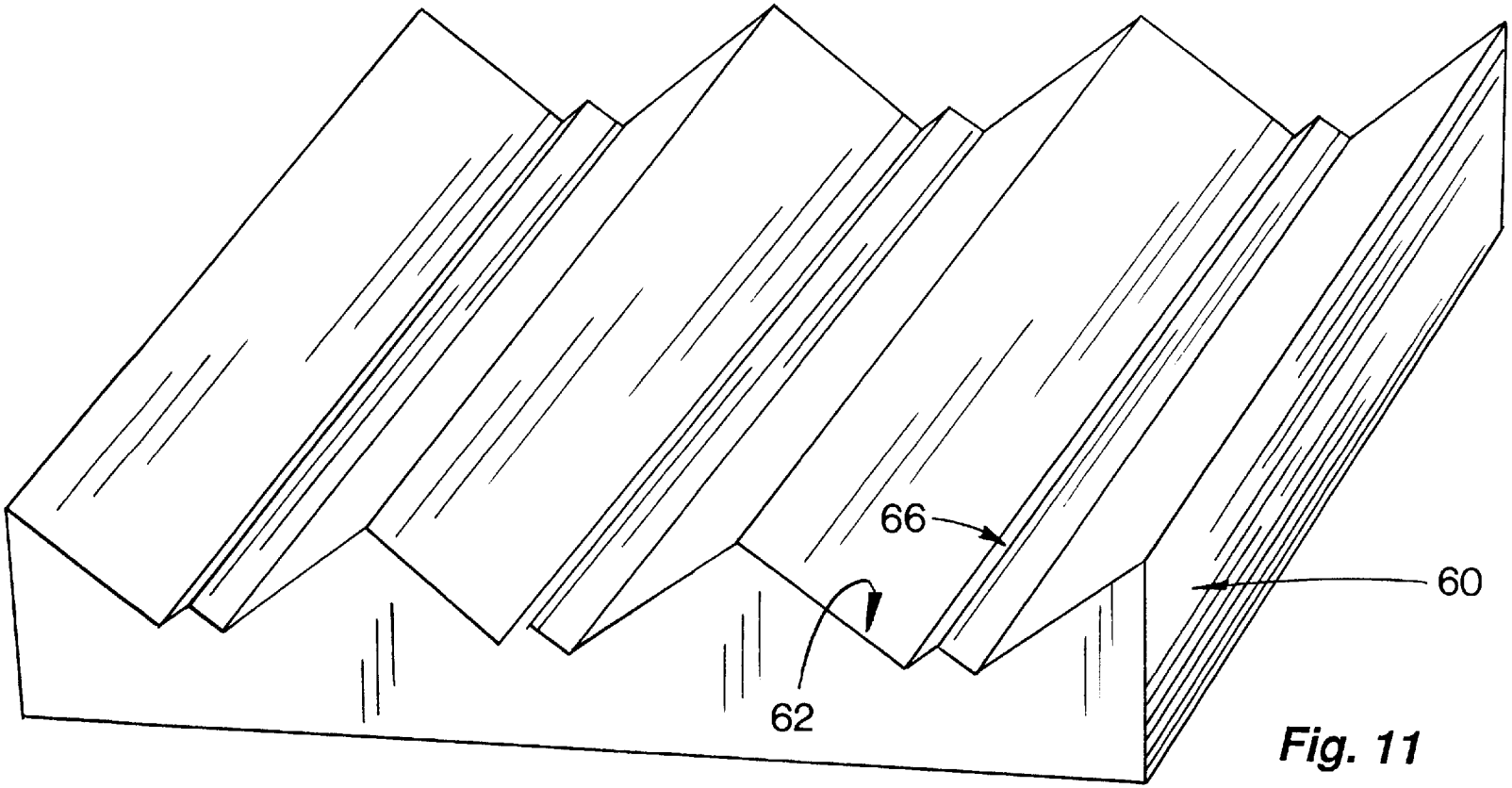

Referring now to FIG. 11, an extruded lens is seen at 60 to comprise extended troughs 62 having elongated inverted apices 66 formed at the bottoms of the troughs 62. It is to be realized that the secondary inversion illustrated in FIG. 9 could be formed from the structure seen in FIG. 11. Multiple secondary inversions can be employed to produce a workable lens structure. It is further to be noted that the structures of FIGS. 8, 9 and 10*b* can be formed by extrusion or by revolving.

It can thus be seen that lens structures according to the invention can be formed by a revolving process or by extrusion with inversions in either situation being typically from 10 to 25% of the height of the geometry being inverted. These geometries can comprise circular based conical geometries as aforesaid as well as elliptical and polygonal-based conical geometries such as pyramids and the like. It is also to be understood that the side walls of the conical prisms 18, for example, can be "hogged out" according to terminology in the art to mean material is "removed" by not having been put in place during forming, for example, in order to further reduce material usage. The geometric shapes which can be used in place of the conical prisms 18 include shapes which are not prisms per se but which are "prismatic" in operation. Further, the grid 26 of cells 22 can be otherwise formed to provide a series of trough-like depressions running through the lens structure such as by extrusion according to the particular example provided hereinabove relative to FIG. 11. As has been described herein, the inverted apex 20 of the lens 12 can itself be inverted as can lens structures such as the extruded structure of FIG. 11. The lens 12 can further be configured with a pattern on the interior face thereof, that is, the face disposed inwardly of the fixture 10 and which faces the lamps 14.

The lens structures of the invention can thus be seen to be conformable in a variety of prismatic patterns which are based upon the inverted apex concept described herein.

The lens structures of the invention can be embodied in forms which have high performance such as an A-12 pattern but with reduced quantities of material forming the lens structure. At the other extreme, the present lens structures can be formed of quantities of material similar to that of present lens structures but which exhibit higher performance than such present structures. The lens structures of the invention can be configured between these extremes as well, particular lens structures being conformed according to preference for performance in relation to cost, that is, the quantity of material employed to form said structures.

Accordingly, it is to be understood that the invention can be configured other than as described explicitly herein without departing from the scope of the invention as defined by the appended claims.

What is claimed is:

1. In a prismatic lighting sheet used as a prismatic lens of a lighting fixture for control of high angle light output and for obscuring lamp image, the lens being formed with a prismatic pattern on a face thereof opposite to lamping disposed within the interior of the lighting fixture, the prismatic pattern having a structural conformation which minimizes the quantity of material necessary for formation of the lens, the pattern being formed of a plurality of cells formed into a grid, at least some of the cells having a female prismatic geometry, an inner portion of said cells being inverted.

2. In the lighting sheet of claim 1 wherein the female prismatic geometry comprises a conical prism.

3. In the lighting sheet of claim 2 wherein the inner portion of the cell comprises a solid body having an apexal conical conformation.

4. In the lighting sheet of claim 3 wherein that face of the lens facing the lamping is unpatterned.

5. In the lighting sheet of claim 1 wherein the female prismatic geometry comprises a pyramid.

6. In the lighting sheet of claim 5 wherein the inner portion of the cell comprises a solid body having an apexal pyramidal conformation.

7. In a lighting fixture having a housing and lamping mounted within the confines of the housing, the housing having an opening trough which light generated by lamping passes for illumination of at least portions of a space within which the fixture is positioned, the opening being at least partially coverved by a transparent prismatic lens, the improvement comprising a prismatic pattern formed in the lens on the face thereof opposite a face of the lens opposed by the lamping the pattern comprising at least one cell opening toward the face on which the pattern is formed, the cell having a female prismatic geometry; an inner portion of the cell being inverted, thereby to reduce extension of the cell into material forming the lens.

8. In the lighting fixture of claim 7 wherein the female prismatic geometry comprises a conical prism.

9. In the lighting fixture of claim 8 wherein the inner portion of the cell comprises a solid body having an apexal conical confirmation.

10. In the lighting fixture of claim 9 wherein the walls of the prism have depressions formed therein.

11. In the lighting fixture of claim 7 wherein the face of the lens opposing the lamping is unpatterned.

12. In the lighting fixture of claim 7 wherein the lens has a plurality of cells formed into a grid.

13. In the lighting fixture of claim 12 wherein the grid is formed diagonally in relation to edges of the lens.

14. In the lighting fixture of claim 12 wherein at least some of the cells have a female prismatic geometry, lower portions of at least some of the cells being inverted.

15. In the lighting fixture of claim 14 wherein the female prismatic geometry comprises a conical prism.

16. In the lighting fixture of claim 15 wherein the inner portion of the cell comprises a solid body having an apexal conical confirmation.

17. In the lighting fixture of claim 15 wherein walls of the prism have depressions formed therein.

18. In the lighting fixture of claim 14 wherein one face of the lens is unpatterned.

19. In the lighting fixture of claim 14 wherein the female prismatic geometry comprises a pyramid.

20. In the lighting fixture of claim 19 wherein the inner portions of at least some of the cells each comprise a solid body having an apexal pyramidal confirmation.

* * * * *